US009657518B2

(12) United States Patent
Mikesell, Sr.

(10) Patent No.: US 9,657,518 B2
(45) Date of Patent: May 23, 2017

(54) EXTENSION LADDER TOOLBOX

(71) Applicant: Andrew Mikesell, Sr., Indianapolis, IN (US)

(72) Inventor: Andrew Mikesell, Sr., Indianapolis, IN (US)

( * ) Notice: Subject to any disclaimer, the term of this patent is extended or adjusted under 35 U.S.C. 154(b) by 0 days.

(21) Appl. No.: 14/170,567

(22) Filed: Jan. 31, 2014

(65) Prior Publication Data

US 2016/0032651 A1 Feb. 4, 2016

Related U.S. Application Data

(60) Provisional application No. 61/759,562, filed on Feb. 1, 2013.

(51) Int. Cl.
*B25H 3/02* (2006.01)
*E06C 7/14* (2006.01)

(52) U.S. Cl.
CPC ..... *E06C 7/143* (2013.01); *B25H 3/02* (2013.01)

(58) Field of Classification Search
CPC ..... B25H 3/02; B25H 3/021; B25H 3/022; B25H 3/023; B25H 3/025; B25H 3/026; B25H 3/027; B25H 3/028; E04G 1/00; E04G 1/30; E06C 5/32; E06C 7/14; E06C 7/143; E06C 7/146; B65D 85/28
USPC ..... 206/372, 373; 182/129; 248/210, 231.2, 248/231.9, 238
See application file for complete search history.

(56) References Cited

U.S. PATENT DOCUMENTS

| | | | | |
|---|---|---|---|---|
| 1,514,885 | A | 11/1924 | Bigler | |
| 3,313,507 | A | 4/1967 | Belli | |
| 2,942,830 | A | 6/1969 | Senay | |
| 3,642,240 | A | 2/1972 | Hershey | |
| 3,842,936 | A | 10/1974 | DeLuca | |
| 3,871,481 | A | 3/1975 | Ballek | |
| 3,878,939 | A * | 4/1975 | Wilcox | B25H 3/023 206/373 |
| 3,976,163 | A | 8/1976 | Watkinson | |
| 3,997,027 | A | 12/1976 | Patterson et al. | |
| 4,077,595 | A | 3/1978 | Carter et al. | |
| 4,586,615 | A | 5/1986 | Quitmann | |
| 4,613,042 | A | 9/1986 | Aeschliman | |
| 4,714,162 | A | 12/1987 | Harrison | |
| 4,964,601 | A | 10/1990 | Dishman | |
| 5,005,710 | A | 4/1991 | Hofer | |
| 5,181,682 | A * | 1/1993 | Indelicato | E06C 7/143 248/210 |
| 5,191,954 | A * | 3/1993 | Ledford | E06C 7/16 182/129 |
| 5,236,161 | A | 8/1993 | Haven | |
| 5,419,409 | A | 5/1995 | Corulla | |
| 5,505,302 | A * | 4/1996 | Ferley | E06C 7/14 182/129 |
| 5,542,535 | A | 8/1996 | Dalton | |

(Continued)

FOREIGN PATENT DOCUMENTS

| | | | |
|---|---|---|---|
| DE | 19920671 A1 * | 11/2000 | E06C 7/143 |
| GB | 2276191 A * | 9/1994 | E06C 7/143 |

*Primary Examiner* — Bryon Gehman
(74) *Attorney, Agent, or Firm* — Woodard, Emhardt, Moriarty, McNett & Henry LLP

(57) ABSTRACT

An extension ladder toolbox which can be attached to the existing holes on the ends of the rungs in such a way that it does not interfere with the users use of the ladder yet it allows for easy access to necessary tools and equipment.

7 Claims, 4 Drawing Sheets

(56) References Cited

U.S. PATENT DOCUMENTS

| | | | | |
|---|---|---|---|---|
| 5,547,080 | A | 8/1996 | Klimas | |
| D374,937 | S | 10/1996 | Salas | |
| 5,584,357 | A | 12/1996 | Gugel et al. | |
| 5,603,405 | A | 2/1997 | Smith | |
| 5,613,574 | A | 3/1997 | Melanson | |
| 5,740,883 | A * | 4/1998 | Trank | E06C 7/14 182/129 |
| 5,950,762 | A | 9/1999 | George | |
| 5,971,102 | A | 10/1999 | Brown | |
| 5,984,046 | A | 11/1999 | Urso, Jr. | |
| 6,269,907 | B1 * | 8/2001 | Gillespie | E06C 7/143 182/129 |
| 6,352,135 | B1 * | 3/2002 | Jones | E06C 7/143 182/129 |
| 6,357,706 | B1 | 3/2002 | Fleckenstein | |
| 6,467,577 | B1 | 10/2002 | Charlebois, Jr. | |
| 6,502,664 | B1 | 1/2003 | Peaker, Sr. | |
| 6,536,590 | B1 | 3/2003 | Godshaw | |
| 6,824,115 | B1 | 11/2004 | Batson | |
| 7,017,598 | B2 | 3/2006 | Nipke | |
| 7,174,994 | B1 | 2/2007 | Coffield et al. | |
| 8,136,774 | B2 | 3/2012 | Melittas | |
| 8,162,275 | B2 | 4/2012 | Reusser | |
| 8,616,912 | B1 | 12/2013 | Vendura | |
| 2002/0104709 | A1 * | 8/2002 | Hines | B25H 3/006 182/129 |
| 2004/0140409 | A1 | 7/2004 | Radda | |
| 2005/0061584 | A1 | 3/2005 | Louthen | |
| 2005/0092550 | A1 | 5/2005 | Lanzafame | |
| 2005/0269156 | A1 | 12/2005 | Lanzafame | |
| 2006/0131106 | A1 * | 6/2006 | Adams | E06C 7/146 182/129 |
| 2006/0163003 | A1 * | 7/2006 | Wigstrom, Sr. | E06C 7/14 182/129 |
| 2007/0056999 | A1 | 3/2007 | Kahn | |
| 2007/0221802 | A1 * | 9/2007 | New, Sr. | E06C 7/143 248/210 |
| 2007/0228237 | A1 * | 10/2007 | Pochurek | E06C 7/143 248/210 |
| 2008/0035426 | A1 * | 2/2008 | Leuthner | E06C 7/143 182/129 |
| 2009/0026155 | A1 | 1/2009 | Bernard | |
| 2009/0152047 | A1 | 6/2009 | McLain | |
| 2011/0079467 | A1 | 4/2011 | Mares | |
| 2011/0232999 | A1 | 9/2011 | Lanzafame | |
| 2013/0192924 | A1 | 8/2013 | Paun | |

* cited by examiner

EXTENSION LADDER TOOLBOX

CROSS-REFERENCE TO RELATED APPLICATIONS

The benefit of U.S. Provisional Patent Application No. 61/759,562 (filed Feb. 1, 2013) is claimed, and that provisional application is hereby incorporated by reference.

FIELD OF THE DISCLOSURE

The present disclosure relates to a toolbox designed to be used in conjunction with existing extension ladders in the realm of tool use, protection, and transportation. More specifically, the present disclosure relates to a toolbox that can be easily attached to and detached from an existing extension ladder of the type commonly used by all sorts of workmen at any construction or other site where hand tools and extension ladders are used simultaneously with considerable frequency to accomplish a given task.

Typically, workmen use their hands, tool belts or other means to transport tools up and down a ladder so that the tools can be accessed to perform work while the workman is on a ladder. Transporting the tools by hand can be unsafe because the workman's ability to grasp the ladder with his hands can be impeded by the tools in his hands. Transporting tools up and down the ladder via a tool belt or other similar means can be fatiguing to a workman and/or dangerous.

DESCRIPTION

For the purpose of promoting an understanding of the principles of the present invention, reference will now be made to the embodiment illustrated in specific language contained herein. It will, nevertheless, be understood that no limitation of the scope of the invention is thereby intended; any alterations and further modifications of the described or illustrated embodiments and any further applications of the principles of the invention as illustrated therein are contemplated as would normally occur to one skilled in the art to which the invention relates.

Figure 1:
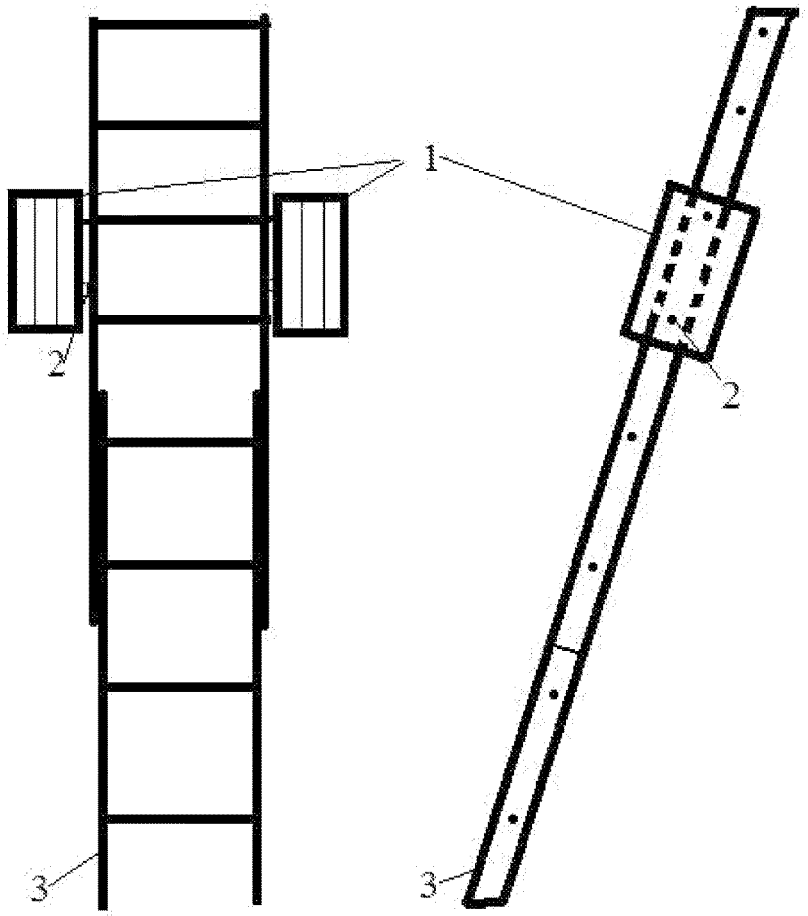
FIG. 1, shows one version of the novel toolbox attached to an extension ladder. In the embodiment shown, the toolbox is a substantially rectangular storage box attached to an extension ladder by means of a short dowel, knob, or pin affixed permanently to the toolbox that is inserted into one of the several holes in one of the two ladder uprights where the ladder rungs are affixed to the ladder uprights. The toolbox in this embodiment is secured to the ladder upright by spring clip hinged to the toolbox that can be clipped to the ladder upright.

One embodiment of this invention could be a substantially rectangular toolbox, 1, as seen in FIG. 1, attached to an extension ladder by means of a short dowel, knob, or pin affixed permanently to the toolbox that is inserted into one of the several holes in one of the two ladder uprights 2 where the ladder rungs are affixed to the ladder uprights 3. The toolbox in this embodiment is secured to the ladder upright by spring clip hinged to the toolbox that can be clipped to the ladder upright. While a nub and spring clip is used in this version to attach the toolbox to the ladder, any similar means should be understood as applicable. The substantially rectangular toolbox 1 includes at least a side face, a front face and a rear face, with the front face and the rear face being substantially perpendicular and the side face extending between an edge of the rear face and the corresponding edge of the front face.

The disclosed form of the invention addresses several key issues faced by users of hand tools working on an extension ladder. Typically, workmen use their hands, tool belts or other means to transport tools up and down a ladder so that the tools can be accessed to perform work while the workman is on a ladder. Transporting the tools by hand can be unsafe because the workman's ability to grasp the ladder with his hands can be impeded by the tools in his hands, increasing the probability of a fall. Tool belts are also commonly used to transport tolls up and down ladders. Tool belts can also present a safety hazard by snagging on the ladder itself, increasing the risk of a fall. Transporting tools up and down the ladder via a tool belt or other similar means can be also be fatiguing to a workman, decreasing productivity and also increasing the probability of mistakes that could lead to a fall or other accident.

The disclosed toolbox addresses these issues by attaching the novel tool box containing tools to the ladder. The disclosed toolbox can be preloaded with the needed tools and attached to the ladder before the ladder is raised into position for the workman to access the work area. The ladder with the toolbox and enclosed tools is raised into place and the tools are awaiting the workman to make his hands-free ascent up the ladder. On multiple trips up and down the ladder, the workman is unburdened by the weight and inconvenience of a tool belt or other similar means of transporting tools up and down the ladder.

Figure 2:
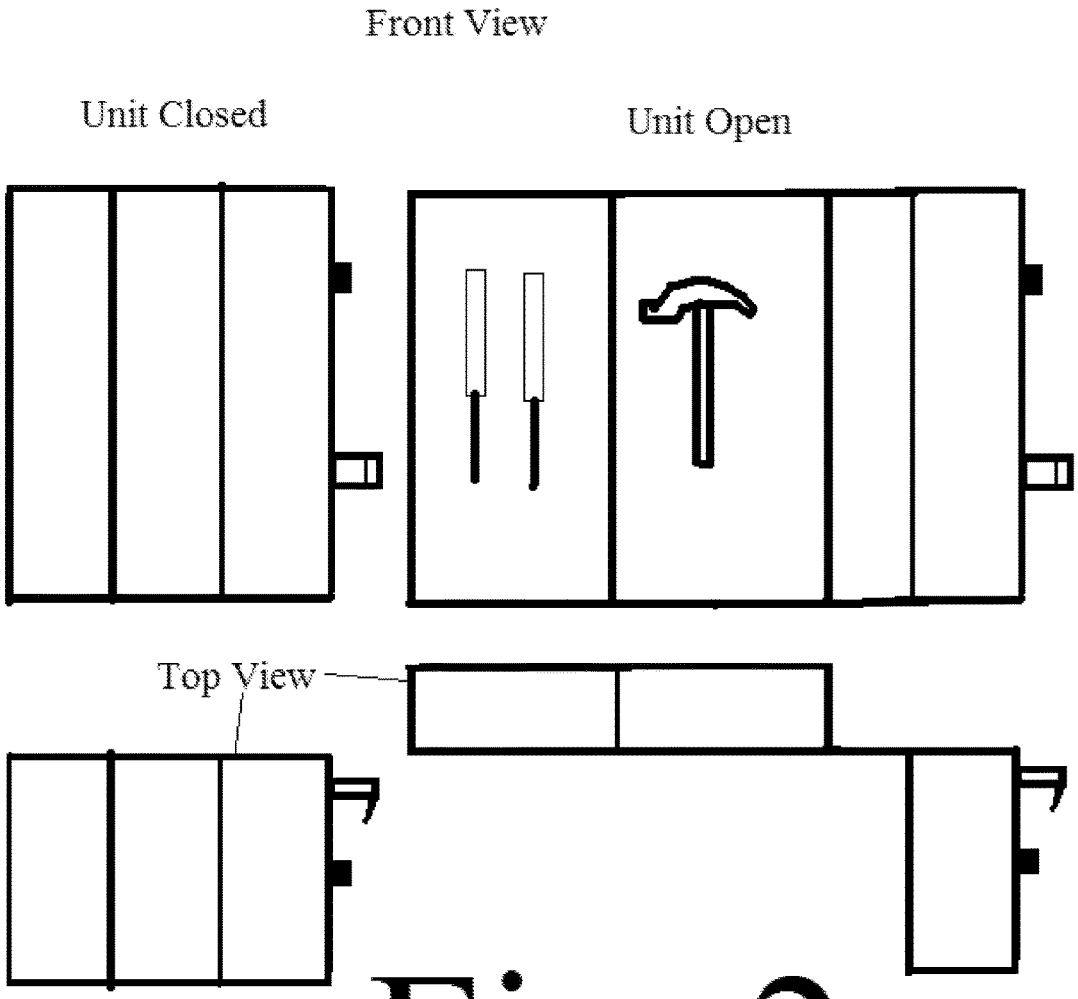
FIG. 2 shows a version of the toolbox with a double hinged door for access to the tools in the toolbox wherein the door can essentially be folded so as not to interfere with the work.

Once up the ladder at the work area, the workman needs to access his tools. An additional feature of the toolbox is the door for access to the tools. In the embodiment shown in FIG. 2, the toolbox has a double hinged door for access to the tools in the toolbox wherein the door can folded so as not to interfere with the work. As shown in FIG. 2, the door comprises two sections connected by a hinge element so that the door can in effect be folded in half, and then folded back against the toolbox itself. The benefit of this configuration is that the door is out of the way so as not to interfere with the movement of the workman or his tools as he performs the task at hand.

Figure 3:
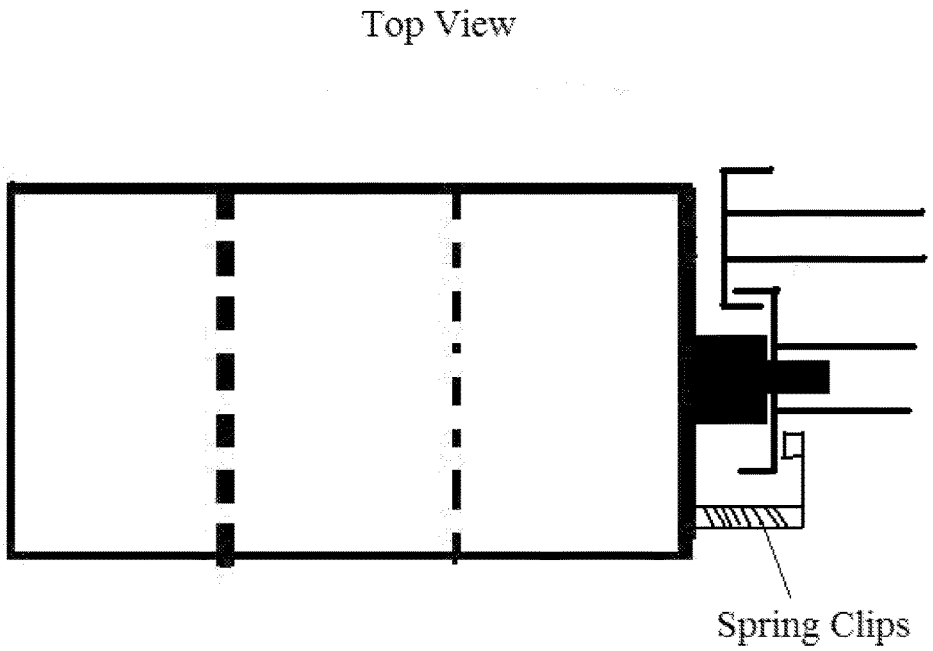
FIG. 3 shows another version of the toolbox where the tools can be accessed from the top of the toolbox by means of a hinged door.

Another aspect of one embodiment could be a hinged half door on the top of the toolbox for access to the tools, as shown in FIG. 3. Tools that are longer and narrower such as paint brushes, caulk guns, or screwdrivers are particularly well suited for a toolbox accessible from the top.

Figure 4:
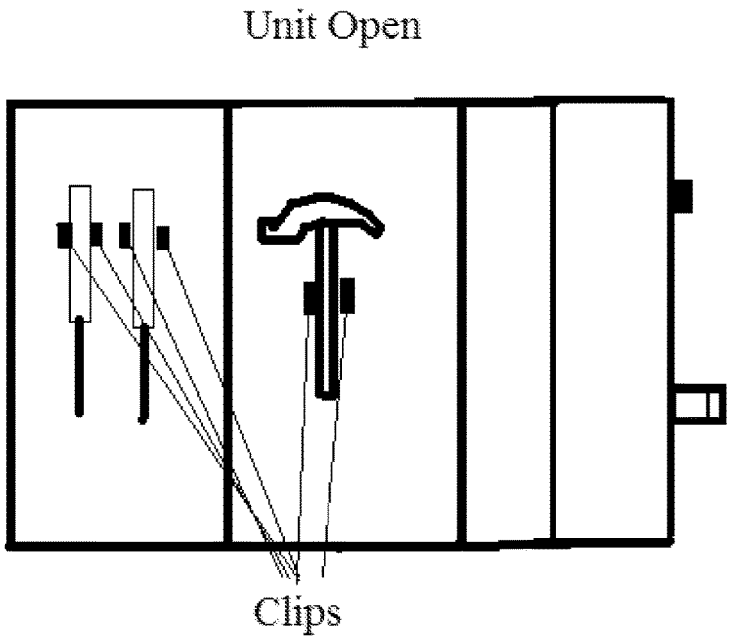
FIG. 4 shows another version of the toolbox wherein the toolbox is secured to an extension ladder with two spring clips.

Another embodiment could also more firmly attach the toolbox to the ladder by using dual spring clips to clip the toolbox to the ladder, as shown in FIG. 4, to take into account a toolbox preloaded with heavier tools that may have a propensity to swing about the axis of the nub or pin. The additional spring clip will serve to stabilize the toolbox relative to the ladder when the ladder is being moved, transported, or being raised into place to access a work area.

Another embodiment of the toolbox could incorporate means for securing tools within the toolbox to inhibit tool movement within the toolbox as when the toolbox is attached to a ladder and the ladder is moved, such as when the ladder is being transported or raised into place to access a work area. In the embodiment, the toolbox interior is fitted with retaining clips suitable for retaining tools suited for the workman's needs. In this embodiment, tools can be snapped into place by the workman preloading the toolbox, thereby precluding movement of the tools within the toolbox when the toolbox or the toolbox and ladder combination is moved. Other equivalent means could be utilized to preclude movement of tools within the toolbox, such as strap and snap systems or hook and loop (e.g. Velcro) systems.

Another embodiment of the toolbox could incorporate means for providing power to electrical tools, such as an outlet or power strip.

A further embodiment could employ two sections which both face toward the user whereby they close onto each other creating a closed and protected area.

A further embodiment could involve fixedly attaching the toolbox, once it a placed onto the ladder.

Another embodiment of the toolbox could incorporate wheels or casters, which could be attached to the ladder in which the toolbox is attached, to facilitate movement of the ladder and toolbox, so that the toolbox need not be removed from the ladder in order to move the ladder from one location to another.

While the invention has been illustrated and described in detail with the foregoing description, the same is to be considered as illustrative and not restrictive in character, it being understood that only the preferred embodiment has been described and that all changes and modifications that come within the spirit of the invention are desired to be protected.

What is claimed is:

1. A toolbox for installation on a ladder having a plurality of parallel hollow rungs spanning two uprights, comprising:

an enclosure made from a rigid material, the enclosure having a side face and a front face, where the front face and side face are perpendicular, and a double-hinged door on the front face for providing access to the interior of the enclosure wherein the double-hinged door comprises two door sections which are hinged to one another;

a pin securely affixed to and extending perpendicularly outward from the side face of the enclosure, wherein the pin is sized so as to fit and extend within a hollow rung of the ladder when the side face of the enclosure contacts an upright of the ladder;

a securement means to retain the pin within the hollow rung of the ladder; and a tool attachment means mounted to a rear face of said enclosure, which is perpendicular to the front face, for securely holding a tool within the enclosure.

2. The toolbox of claim 1, wherein the tool attachment means is a retaining clip.

3. The toolbox of claim 1, further comprising a plurality of tool attachment means mounted within said enclosure for securely holding tools within the enclosure.

4. The toolbox of claim 3, wherein the plurality of tool attachment means comprises a plurality of retaining clips.

5. The toolbox of claim 1, wherein the securement means comprises at least one spring clip.

6. A ladder having a toolbox accessible to a user, comprising:

a first upright and a second upright;

a plurality of parallel hollow rungs connected to and spanning the first and second uprights;

an enclosure made from a rigid material, the enclosure having a side face and a front face, where the front face and side face are perpendicular, and a double-hinged door on the front face for providing access to the interior of the enclosure wherein the double-hinged door comprises two door sections which are hinged to one another;

a pin securely affixed to and extending perpendicularly outward from the side face of the enclosure, wherein the pin is sized so as to fit and extend within a hollow rung of the ladder when the rear face of the enclosure contacts an upright of the ladder;

a securement means to retain the pin within the hollow rung of the ladder; and a tool attachment means mounted to a rear face of said enclosure, which is perpendicular to the front face, for securely holding a tool within the enclosure.

7. The ladder of claim 6, wherein the tool attachment means is a retaining clip.

* * * * *